United States Patent [19]

Guiraud

[11] 4,100,647

[45] Jul. 18, 1978

[54] PIVOT DEVICE FOR DOORS OF STRONG BOXES, SAFES OR THE LIKE

[75] Inventor: François Guiraud, Chambourcy, France

[73] Assignee: Fichet-Bauche, Velizy, France

[21] Appl. No.: 798,189

[22] Filed: May 18, 1977

[30] Foreign Application Priority Data

May 25, 1976 [FR] France ..... 76 15810

[51] Int. Cl.[2] ..... E05D 11/10; E05D 3/06

[52] U.S. Cl. ..... 16/139; 16/146; 16/163; 16/164

[58] Field of Search ..... 16/164, 163, 165, 166, 16/146, 147, 139; 109/64; 292/228, 292; 220/334, 355

[56] References Cited

U.S. PATENT DOCUMENTS

| | | | |
|---|---|---|---|
| 2,151,732 | 3/1939 | Boyle | 16/146 |
| 2,771,042 | 11/1956 | Deaton | 16/163 X |
| 3,860,995 | 1/1975 | Lautenschlager, Jr. et al. | 16/139 |
| 3,991,437 | 11/1976 | Friederichs et al. | 16/139 |

FOREIGN PATENT DOCUMENTS

| | | | |
|---|---|---|---|
| 2,502,774 | 7/1976 | Fed. Rep. of Germany | 16/139 |
| 399,234 | 3/1966 | Switzerland. | |
| 1,222,838 | 2/1971 | United Kingdom | 16/163 |

*Primary Examiner*—James Kee Chi

[57] ABSTRACT

A pivot device is disclosed for use in connection with the doors of containers such as safes, vaults and the like. It provides for the door to consecutively pivot around two separate axes when it is fully opened or closed. The pivots themselves are located within the container to prevent tampering.

6 Claims, 10 Drawing Figures

PIVOT DEVICE FOR DOORS OF STRONG BOXES, SAFES OR THE LIKE

BACKGROUND OF THE INVENTION

1. Field of the Invention

This invention relates to a pivot device which may be used in connection with containers, chests, trunks, safes, strongboxes, vaults or analogous types of devices in which a secure pivoting mechanism is desired. Specifically, the invention relates to a pivot device which is attached to the door of the container.

2. Description of the Prior Art

The prior art has recognized various types of pivot devices. For example, a pivot device has been proposed which has no pivots on the exterior face of the door which could be subject to tampering. Furthermore, because the pivots themselves are located in the interior of the container, when the container door is in a closed position it is virtually impossible to locate and thus to interfere with the pivots themselves. In such a device one is able to completely free the opening of the container by rotating the door 180°.

Swiss Pat. No. 399,234 illustrates such a device. The pivot device disclosed has two parallel pivoting axes. When the door is first opened it revolves around a first axis. After the door has been opened partially the door begins to rotate around a second axis. This device comprises a release type of mechanism whose resistance must be overcome in the course of fully opening the door in order to transfer the revolution of the door from around one axis to the other. As a result, with the device disclosed, it is necessary to exert greater effort in the course of opening and closing of the door than would normally be required to overcome the inertia of the door itself. Furthermore, such a device requires that the different parts of the mechanism be machined to tolerances which allow for mechanical play between the elements. With wear, the tolerances are exceeded and the pieces cannot be easily remachined.

German Offenlegunsschrift No. 2,354,282 describes a pivoting device for the rear door of a car door which has two axes. In this device, the hinge-pins are located on the outside of the door. The hinge-pins are thus subject to tampering which is, of course, undesirable from the point of view of security.

BRIEF SUMMARY OF THE INVENTION

It is an object of the invention to provide an improved pivoting device of the general type described above, i.e., a pivot device having two axes of rotation, which does not suffer from the above-mentioned disadvantages.

Another object of the invention is to provide a pivot device for use in connection with the doors of strongboxes, safes, vaults or the like whose hinges are protected within these containers and whose location cannot be discovered by examination of the outsides of the doors.

It is a further object of the invention to furnish an improved pivot device which can be easily installed and adjusted.

It is yet a further important object of this invention to provide an improved pivot device which does not significantly add to the resistance normally encountered when opening or closing the door to which it is attached.

A further object of the invention is to provide a pivot device for use in combination with a door, which comprises a U-shaped section having two branches, the free end of the first branch being connected to a pivot shaft, the second branch being attached to an arm at its lower end; said arm being a planar member having a hole at its end which is spaced from said second branch, and which has a fork attached to it; said fork comprising two parallel planar flap means which are spaced from one another and which are substantially parallel to the plane of said arm.

It is also an object of the invention to provide a container comprising: an opening having a swinging door attached thereto; a pivot device comprising: a U-shaped section having a first and a second branch; a first pivot shaft being connected to the free end of the first branch of the section, said pivot shaft being rotatably mounted in said container; pivot means attached to the end of the second branch of the section, said door being attached to said pivot means such that said door is free to pivot around said pivot means with respect to said section; a second pivot whose longitudinal axis is parallel to said first pivot; a toothed rocker mounted on said second pivot; a grooved guide means being attached to said door, said guide being adapted and arranged to contact the tooth of said rocker when said door is in the closed position; an adjustable stop means attached to said section which is mounted such that it contacts the interior of said door when said door is opened beyond a certain extent; said pivot device being constructed such that in the course of opening the door to a position 180° from its starting position, the door first pivots around said pivot means and upon further opening said door pivots about said first pivot-shaft.

DETAILED DESCRIPTION OF THE INVENTION

Generally, the invention comprises a pivoting device which is to be attached to the doors of containers such as safes, vaults, strong-boxes or of any other types of containers. The pivoting device is positioned and is adapted such that when the door is opened it rotates first about one axis and then upon being further opened, around a second axis. The door itself is connected to a U-shaped section. One end of the section is connected to a shaft which is rotatably connected to the body of the container. The other end of the section is connected through a series of elements to the door. The door is provided with pivot means which are pivotably connected to these elements.

The invention will now be more specifically described by reference to the attached drawings.

Figure 1:
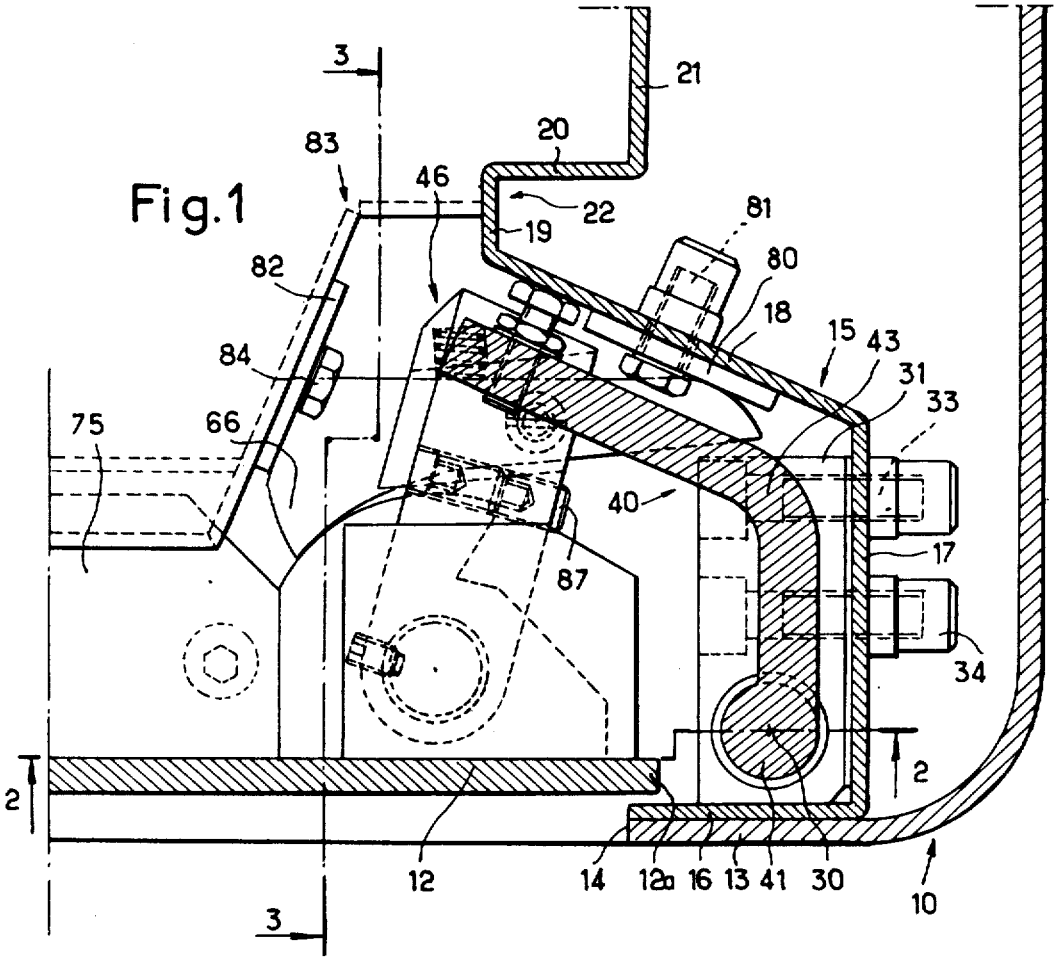
FIG. 1 is a horizontal cross-sectional view of a door equipped with the device of the invention.
Figure 2:
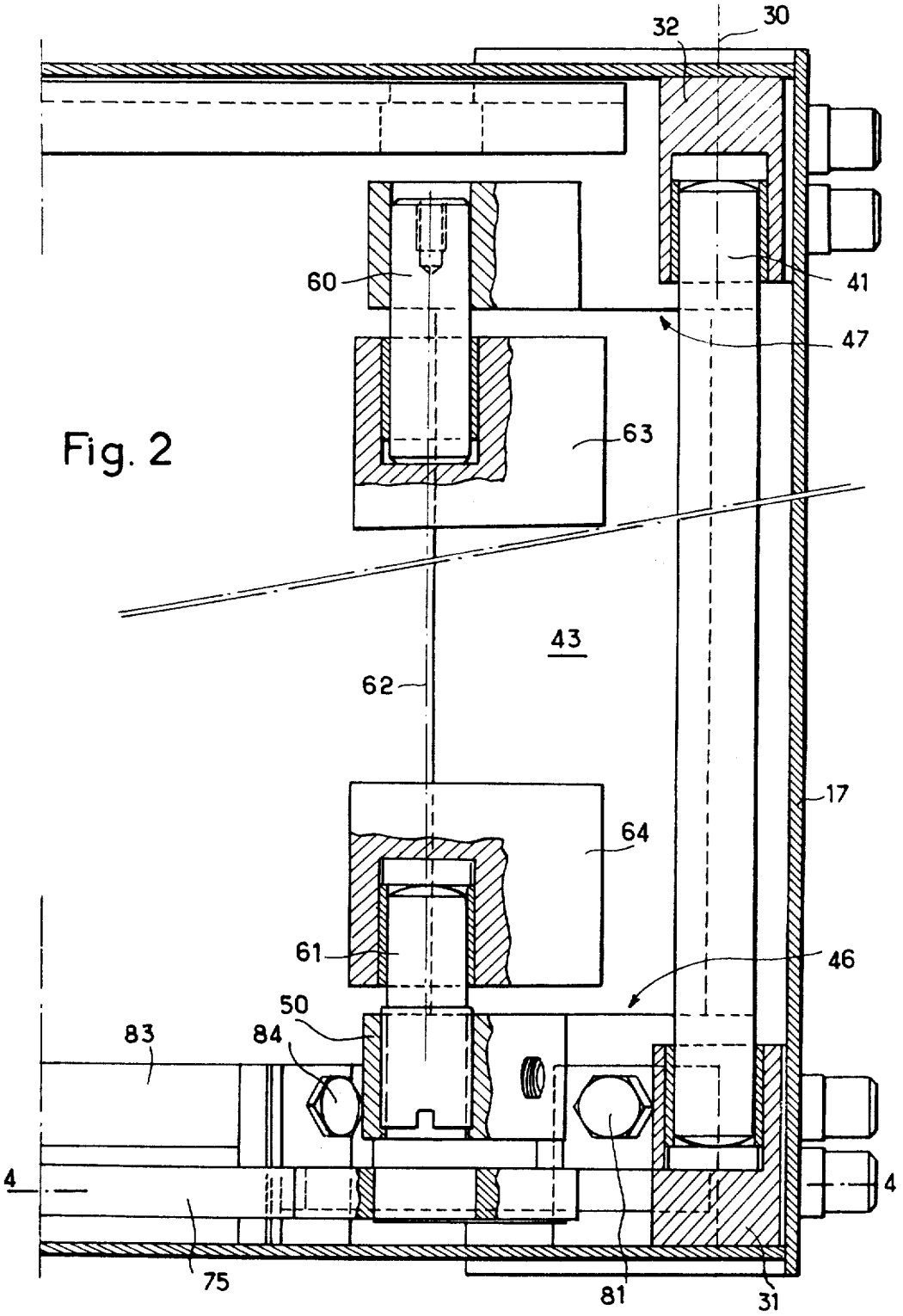
FIG. 2 is a cross-sectional view taken along line 2—2 in FIG. 1.

A container, or chamber as for example a strong-box or safe, is illustrated in FIG. 1. The chamber 10 has a front opening 11 which is bordered by a vertical edge 14, of wall 13. Door 12 is arranged so that when it is in its closed position it closes off opening 11. A metallic section 15 is mounted on the wall 13 parallel to the door 12 when it is in the closed position. Section 15 may be attached to the casing by any known means, for example, by soldering. The section has a flange 16 which is parallel to the door when the door is in its closed position, and a flange 17 which is perpendicular to flange 16 and which is joined to the latter. Flange 18 extends from flange 17 at an obtuse angle. As shown in FIG. 1, flange 18 leads into flanges 19, 20 and 21 which are bent an angles to one another; flanges 19 and 20 forming heel 22.

Figure 8:
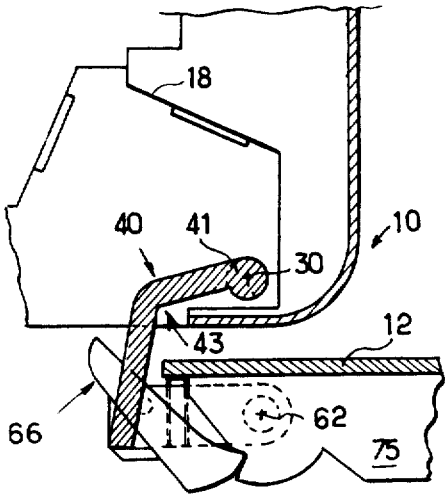

Swinging door 12 is attached to the chamber 10 by means of a number of parallel pivoting axes such that the end-face 12*a* of the door 12 which is adjacent to the pivoting axis 30 is inaccessable and is hidden by the edge 14 of the chest when the door is in the closed position. Yet, as shown in FIG. 8, the door may nevertheless be opened to a full extent of 180° from its original closed position so as to completely free the opening 11.

Figure 3:
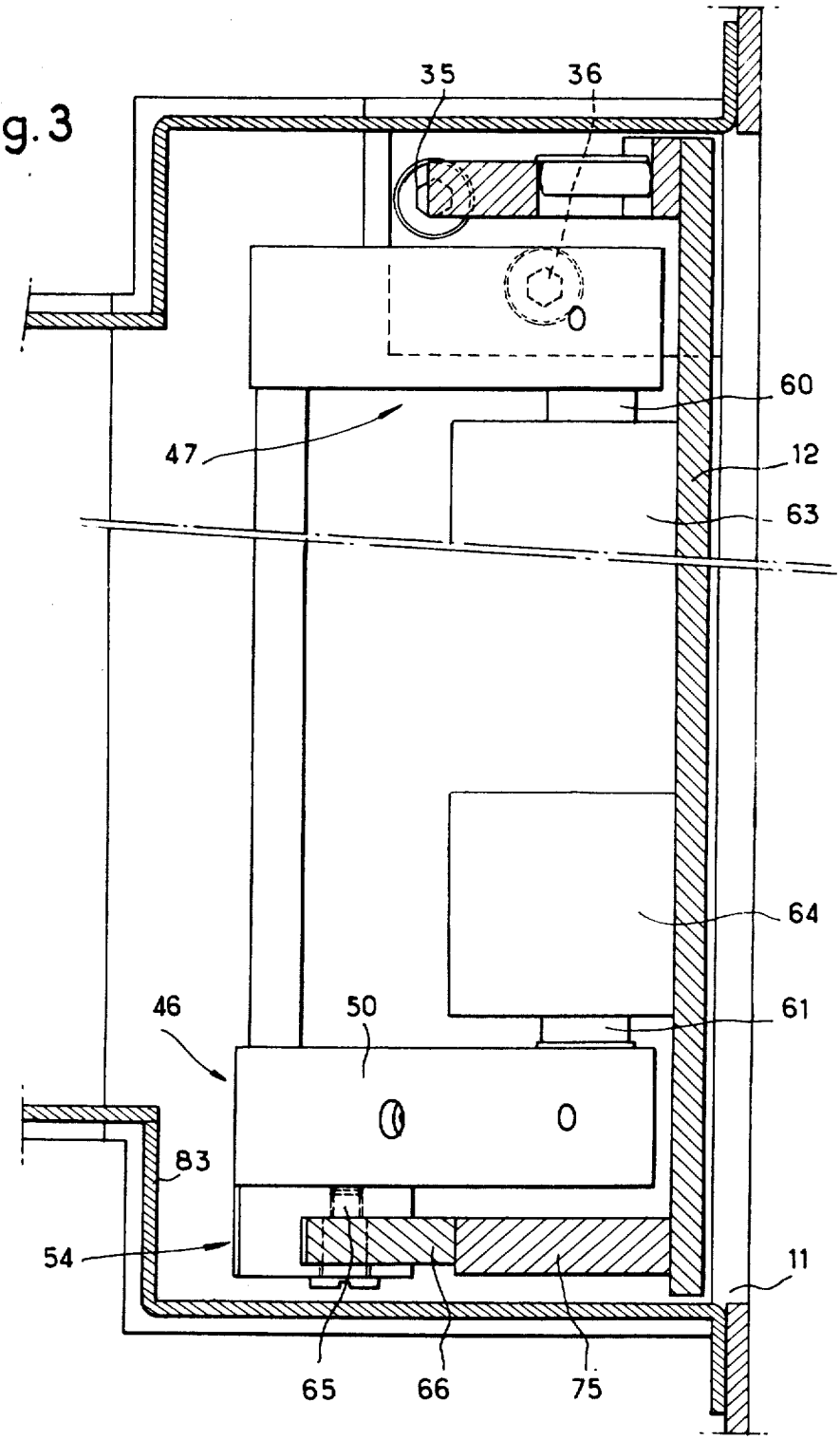
FIG. 3 is a cross-sectional view taken along line 3—3 in FIG. 1.
Figure 5:
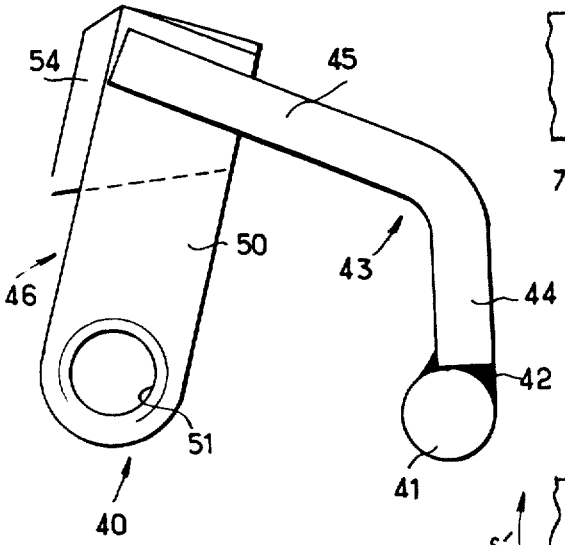
FIG. 5 is a top view of part of the mechanism of the device of the invention.
Figure 5B:
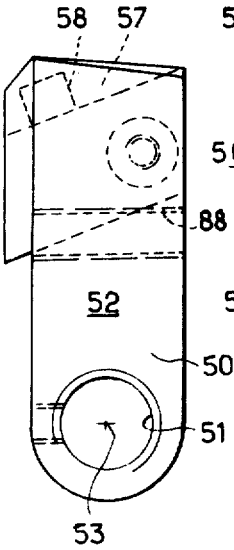
FIG. 5B is a top view of the flange shown in FIG. 5A.
Figure 5A:
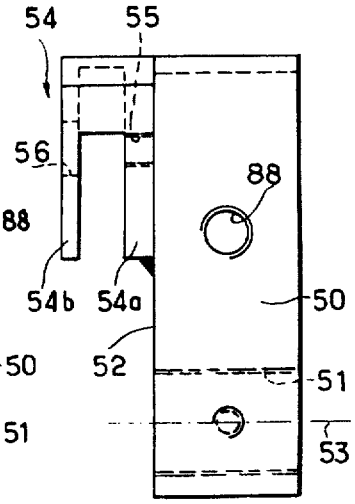
FIG. 5A is a side view of the flap of the mechanism shown in FIG. 5.

In the embodiment described and shown, the first pivoting axis is shown as 30 in FIGS. 1, 2 and 6 to 8. This pivot axis is maintained by a pivot means. As shown, two bushings 31 and 32, the first being attached to the lower part, and the second to the upper part of the chest, preferably to the flange 17 of the section 15 by screws shown as 33 and 34, FIG. 1, for the lower bushing, and 35, 36, FIG. 3, for the upper bushing. A pivot group 40 cooperates with the said bushings. The pivot group 40 has a cylindrical arm or as it is properly called a pivot shaft, 41, on which is soldered, as is shown in 42 of FIG. 5, a sheet 43 of sheet metal. Although soldering is disclosed, any other conventional means of connecting the two may of course be used. As it appears in FIG. 5, the sheet is bent into a U-shaped section having two branches, i.e., a branch 44, which is substantially parallel to flange 17 of section 15 when the door is in the closed position, and a branch 45, which is substantially parallel to the flange 18 of section 15 when the door is in the same closed position. At its upper and lower extremities, the section 45 of the sheet 43 is connected to flaps 46 and 47, respectively. Flap 46 is assembled, as for example by soldering, and comprises (FIGS. 5, 5A and 5B), an arm 50 and a fork 54.

The arm 50 has a transverse borehole 51, an axis 53 and a tapped hole 88 perpendicular to the said borehole. The flaps 54*a* and 54*b* of the fork 54 —disposed on the side 52 of the arm 50 and being perpendicular to the axis 53— are both drilled. The first flap 54*a* has a borehole 55 and the second flap 54*b* has an opening 56. The end of the fork 54 has a one-eyed hole 58 drilled into it. Pivot 60 is located in flap 47 which consists only of an arm 50 and which has no fork 54. This pivot, together with pivot 61 which is fixed in borehole 51 of the flap 46, defines the second pivoting axis 62 of the device. More precisely, they define the axis of the swinging door 12 which hangs on the pivots 60 and 61 by the bushings 63 and 64, respectively.

In the fork 54 is mounted a "bascule" 66 which pivots around a shaft 65, which is inserted within borehole 55. The bascule is, in effect, an elongated toothed rocker having one side 67 (FIG. 4) whose edge is rectilinear and which terminates at one end in a rounded section 68, while its other end is joined with a similarly rounded edge 69 with which it forms an obtuse angle. The rounded portion 68 is connected to a side edge 70 which is rectilinear over the greater part of its length and which, at its end which is spaced from the rounded section 68, forms a rounded portion 71. Portion 71 is connected to edge 69 by a rounded surface 72; rounded portion 71 and rounded surface 72 forming between them a tooth 73.

Figure 4:
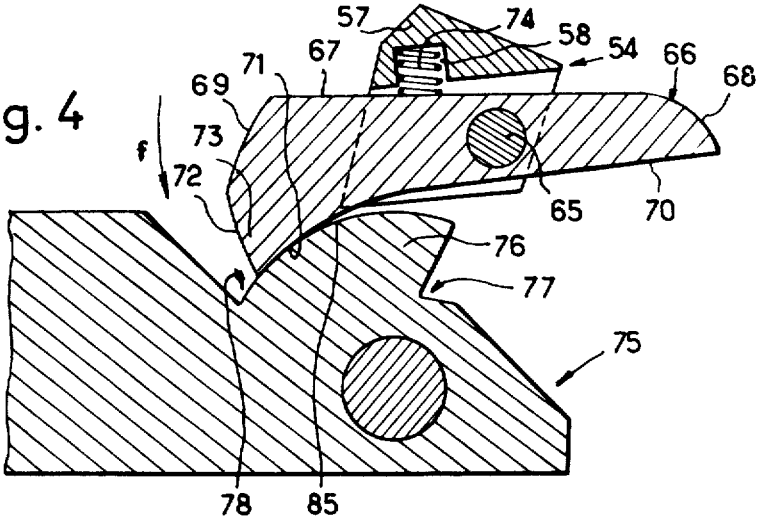
FIG. 4 is a partial view, in cross-section, taken along line 4—4 in FIG. 2.

A "catch" or grooved guide means 75 is illustrated in FIG. 4 which is adapted to cooperate with the rocker 66. It acts together with rocker 66 which is itself acted upon by a spring 74 which is lodged in the one-eyed hole 58. Guide 75, which is soldered onto the swinging door 12, is in the form of a flat piece of metal. The guide is of the same thickness as the rocker 66. The guide has, to both sides of tooth 76, grooves 77 and 78 which are adapted to receive the tooth 73 of the rocker.

The toothed rocker is arranged such that its rounded part 68 can cooperate with a wedge 80, which is of adjustable thickness and which is attached to the flange 18 by a screw 81. The thickness of the wedge may be adjusted by varying the number and/or thickness of the small metal plates which comprise wedge 80. Additionally, it is arranged such that edge 69 of the rocker can cooperate with shoulder 82, which is likewise of adjustable thickness. Shoulder 82 is attached by a screw 84 to an angle plate 83 which is attached to the section 15.

The device operates as follows:

When the strong-box or safe is closed, it is in the position shown in FIG. 1. Portion 44 of sheet 43 is relatively parallel to flange 17 of section 15 while portion 45 of the said sheet is relatively parallel to flange 18 of the said section. The rounded section 68 of rocker 66, which is induced to pivot in the direction of arrow *f* by the spring 74, is in contact with wedge 80. The swinging section 12 of the door blocks the opening 11 while the groove 78 of the guide 75, which is on the swinging door, partially receives tooth 73 of the rocker.

To open the chest, the user pulls the swinging door 12 towards him. This causes the door to pivot around axis 62 (FIG. 6) thus entraining along with it the guide 75. The interior side 85 of the tooth 76 is shaped and positioned such that it resists the rotation of the rocker 66 around the axis 65.

The pivoting of the swinging door 12 around the axis 62 continues until the part of the door adjacent to the edge 12*a* comes into contact with a stop means defined by a screw 87 (FIG. 1). The screw is located within a the tapped hole 88 such that its projection with respect to the arm 50 can be adjusted. In the course of the movement of the pivot which causes the swinging door 12 to move from the position shown in FIG. 1 to the position shown in FIG. 6, the pivot group 40 remains stationary. This result follows because of the coaction of the shoulder stop 82 with edge 69 of the rocker 66.

Figure 6:
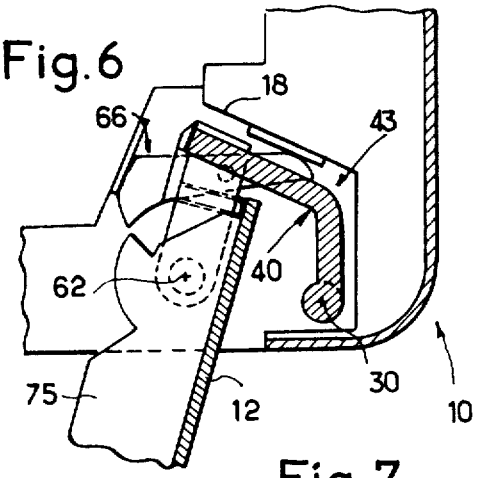
FIGS. 6 to 8 show a door which is equipped with a device according to the invention in various positions.

When, starting from the position shown in FIG. 6, the door is further opened, the pressure on the flaps 46 and 47, which is exerted by means of one or several screws 87, rotates the pivot group 40 which comprises sheet 43 which is connected to said flaps. This rotational movement disengages the rocker 66 from the shoulder 82 and, as the pivoting movement of the door progresses, the rocker, induced by the spring 74, pivots around its axis 65 until it occupies the position shown in FIG. 7. As shown in this figure, the tooth 73 becomes lodged in groove 77 of the guide 75. If the swinging door 12 is further pushed or pulled, the swinging door continues its rotational movement around the axis 30, until it occupies the position shown in FIG. 8. It thus completely moves away from the opening 11 of the chest or safe after a pivoting of 180° with respect to its initial position.

Figure 7:
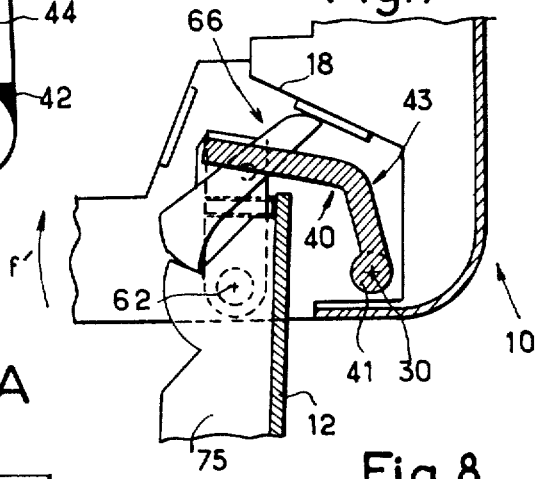

To close the chest or vault, the swinging door 12 is first brought from the position shown in FIG. 8 to the position shown in FIG. 7. This occurs by virtue of rotation around axis 30. In this phase of the closing of the door, the rocker 66 is displaced by the guide 75, by virtue of interaction with tooth 73 of the rocker and the groove 77 of the catch in which the said tooth is lodged. Also in the course of this movement, the rounded section 68 of the rocker 66 comes into contact with the wedge 80. Upon continuation of the closing motion, i.e., the swinging door 12 being further turned in a pivoting motion in the direction of arrow *f*, the rocker 66 is caused to pivot within the fork 54 around its axis 65, against the action of spring 74, until the tooth 73 escapes toward the tooth 76 and until the edge 69 again becomes flush with the shoulder 82. From this position the guide 75 can disengage from the rocker 66. The pivoting movement of the swinging door continues, around axis 62, until the swinging door is brought back to the position shown in FIG. 1.

By splitting the opening movement into two periods, first by pivoting around axis 62, then around axis 30, the door traverses a precisely defined motion throughout the entire opening cycle.

With the device of the invention, once shoulder 82 has been adjusted, as can be most simply done with the aid of small plates of varying thickness maintained in position by the screw 84, the operation conditions disclosed above are easily maintained, without further need for adjustment.

The drawings and specification present a detailed disclosure of a preferred embodiment of the invention, and it is to be understood that the invention is not limited to the specific forms disclosed, but covers all modifications changes and alternative constructions falling within the scope of the invention as defined by the claims.

I claim:

1. In a container such as a safe having an opening and a swinging door attached thereto; a pivot device which comprises:

a shaped section including first and second branches, the first branch having a free end, said second branch having an end, a first pivot shaft connected to the free end of said first branch of the section, said pivot shaft being rotatably mounted in said container, pivot means attached to the end of the second branch of the section and having an axis parallel to that of said first pivot shaft, said door being attached to said pivot means, a rocker, a second pivot shaft rotatably mounting said rocker on said shaped section, said second pivot shaft having an axis extending parallel to the axes of said first pivot shaft and said pivot means, said rocker including a tooth and a curved portion.

an element mounted on the inner face of said door and having a curved portion complementary with said curved portion of the rocker, said element further having a recess, said curved portions of said element and said rocker being positioned to contact each other and said recess being positioned to receive said tooth of the rocker, first stop means for said rocker for preventing rotation of said rocker when said complementary curved portions contact each other in order to allow the rotation of the door around the pivot means, second stop means on the shaped section positioned so that the door comes in contact with said second stop means at the end of a first movement of opening of the door by rotation around said pivot means, and spring means for urging the tooth of the rocker into the recess during a second movement of opening of the door by rotation around said first pivot shaft.

2. A pivot device according to claim 1, comprising a fork attached to said second branch of the shaped section, said rocker being rotatably mounted on said fork.

3. A pivot device according to claim 1, wherein said first stop means comprises a first adjustable stop inside said container.

4. A pivot device according to claim 3, wherein said first adjustable stop includes a plate fixed to a second shaped section inside said container.

5. A pivot device according to claim 3, wherein said first stop means comprises a wedge positioned to cooperate with that part of the rocker which is opposed to the first adjustable stop with respect to the axis of rotation of the rocker.

6. A pivot device according to claim 1 wherein said second stop means comprises an adjustable stop.

* * * * *